US008172610B2

(12) United States Patent
Kurachi

(10) Patent No.: US 8,172,610 B2
(45) Date of Patent: May 8, 2012

(54) ELECTRIC CONNECTOR

(75) Inventor: Takaki Kurachi, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 12/888,654

(22) Filed: Sep. 23, 2010

(65) Prior Publication Data

US 2011/0136380 A1 Jun. 9, 2011

(30) Foreign Application Priority Data

Dec. 4, 2009 (JP) ..... 2009-276452

(51) Int. Cl.
*H01R 9/05* (2006.01)

(52) U.S. Cl. ..... 439/578

(58) Field of Classification Search ..... 439/578, 439/497, 607.4, 607.31, 607.32, 607.01
See application file for complete search history.

(56) References Cited

U.S. PATENT DOCUMENTS 6,685,509 B1 * 2/2004 Yeh ..... 439/607.22
6,843,679 B2 * 1/2005 Kuo et al. ..... 439/497
6,902,432 B2 * 6/2005 Morikawa et al. ..... 439/607.41
7,878,843 B2 * 2/2011 Zhang ..... 439/497
7,993,151 B2 * 8/2011 Chuo et al. ..... 439/260

FOREIGN PATENT DOCUMENTS

JP 2003-331993 11/2003
JP 2009-199891 9/2009

OTHER PUBLICATIONS

U.S. Appl. No. 29/387,653, filed Mar. 16, 2011, Kurachi.
U.S. Appl. No. 29/387,652, filed Mar. 16, 2011, Kurachi.

* cited by examiner

*Primary Examiner* — Phuong Dinh
(74) *Attorney, Agent, or Firm* — Oblon, Spivak, McClelland, Maier & Neustadt, L.L.P.

(57) ABSTRACT

To make it possible to improve the grounding property of a conductive shell with a simple configuration.
Connector-side ground connecting members (ground spring pieces) 24*c* provided in a conductive ground shell 24 of a receptacle connector 2 and board-side ground connecting members (rear holddowns) 24*b* are disposed such that they extend approximately in parallel with a fitting direction of a plug connector 1 serving as a fitting mate for the receptacle connector 2, and ground currents flowing between the connector-side ground connecting members 24*c* and the board-side ground connecting members 24*b* take the shortest straight courses so that occurrence of electrical loss or an undesired inducing phenomenon is substantially suppressed.

4 Claims, 6 Drawing Sheets

ELECTRIC CONNECTOR

BACKGROUND OF THE INVENTION

1. Field of the Invention

The present invention relates to an electric connector configured to be fitted to a connector to perform electrical connection of a signal transmission medium such as a coaxial cable.

2. Description of the Related Art

In a variety of ordinary electrical equipments or the like, an electric connector is widely used for the purpose of connecting a terminal portion of a signal transmission medium comprising a coaxial cable or the like to a printed wiring board. The electric connector comprises, for example, a plug connector to which the signal transmission medium is connected and a receptacle connector mounted on the printed wiring board, and, first, the signal transmission medium such as a coaxial cable is connected to a rear end edge of the plug connector, thereafter, a projection for fitting provided in the plug connector is inserted into an opening for fitting of the receptacle connector, and thus both the connectors are fitted to each other.

Such an electric connector has a main body housing formed of an insulating member and a conductive ground shell is attached to the main body housing in order to form a signal shield or ground circuit. Then, for example, as also described in the following patent literatures, the conductive ground shell has a connector-side ground connecting member (a ground spring piece or the like) that is brought in contact with a conductive ground shell of another connector serving as a fitting mate for the electric connector, and it is also provided with a board-side ground connecting member (a soldering piece or the like) that is brought in contact with the above-described printed wiring board or an arbitrary board formed as a signal transmission medium such as a flexible printed circuit (FPC) or a flexible flat cable (FFC).

The connector-side ground connecting member (the ground spring piece or the like) and the board-side ground connecting member (the soldering piece or the like), which are provided on the conductive ground shell, may be formed of tongue-piece-like members integrated with a main body of the conductive ground shell in some cases, or may be formed as independent contact members in other cases, but, in any case, the connector-side ground connecting member and the board-side ground connecting member are electrically connected to each other, thereby the connector serving as a fitting mate for the electric connector and the board are ground-connected to form a ground circuit.

However, generally, the connector-side ground connecting member (the ground spring piece or the like) and the board-side ground connecting member (the soldering piece or the like) of the above-described conductive ground shell are disposed without considering their positional relationship. That is, the connector-side ground connecting member of a connector is disposed at a position suitable to another connector serving as a fitting mate for the connector, while the board-side ground connecting member of the another connector is disposed at a position suitable to a board to be connected. As a result, the positional relationship between both the connecting members is such that they are arbitrarily dispersed, therefore there is the possibility that a ground current (an earth current) to be caused to flow between both the connecting members flows toward the board-side ground connecting member disposed at a suitable position within the conductive ground shell, electrical loss or an undesired inducing phenomenon occurs, which may result in adverse influence on the grounding property of the conductive ground shell.

[Patent Literature 1: JP-A-2009-199891

[Patent Literature 2: JP-A-2003-331993

SUMMARY OF THE INVENTION

Therefore, an object of the present invention is to provide an electric connector with a simple configuration that can improve the grounding property of the conductive ground shell.

In order to achieve the above object, according to an aspect of the present invention, there is provided an electric connector where a conductive ground shell attached to a main body housing is provided with a connector-side ground connecting member that is brought into contact with a conductive ground shell of a connector serving as a fitting mate for the electric connector and a board-side ground connecting member that is brought in contact with a printed wiring board, and both the connector-side ground connecting member and the board-side ground connecting member are formed to extend in a cantilever form, wherein a configuration is adopted in which extending directions of the connector-side ground connecting member and the board-side ground connecting member extending in the cantilever form are set approximately in parallel with a fitting direction in which the connector serving as a fitting mate is inserted and approximately in the same direction as the fitting direction.

Further, in the present invention, there is provided an electric connector used in the state of being inserted with a connector serving as a fitting mate for the electric connector comprising: a main body housing formed of long and thin insulating members, a conductive ground shell attached to the main body housing, a connector-side ground connecting member brought into contact with a conductive ground shell of a connector serving as a fitting mate for the electric connector, a board-side ground connecting member brought in contact with a printed wiring board, both the connector-side ground connecting member and the board-side ground connecting member which extend in a cantilever form are arranged in a plurality at suitable intervals along the longitudinal direction of the main body housing, wherein the extending directions in the cantilever form of the connector-side ground connecting member and the board-side ground connecting member are set approximately in parallel with the inserting direction of the connector serving as a fitting mate for the electric connector and approximately in the same direction as the fitting direction, and wherein a plurality of projections is formed at the both sides of the connector-side ground connecting member and/or the board-side ground connecting member, and arranged along the longitudinal direction of the main body housing, so as to extend from the conductive ground shell along the fitting direction of the connector serving as a fitting mate for the electric connector for the entire length thereof to be inserted into the main body housing.

According to the electric connector having such a configuration, a ground current flowing between the connector-side ground connecting member and the board-side ground connecting member takes the shortest straight course so that electrical loss or occurrence of an undesired inducing phenomenon is substantially suppressed.

Further, according to the electric connector having such a configuration, since the connector-side ground connecting member and the board-side ground connecting member extend in a forward direction with respect to a direction in which the connector serving as a fitting mate for the electric connector is fitted to the electric connector, the possibility that the connector serving as a fitting mate collides with the connector-side ground connecting member at a fitting time of the connector serving as a fitting mate for the electric connector is eliminated so that deformation such as buckling or damage is prevented from occurring.

Further, in the present invention, the electric connector can adopt a configuration in which at least one of the connector-side ground connecting member and the board-side ground connecting member is formed of a tongue-shaped member integrated with the conductive ground shell or a contacting member independent of the conductive ground shell.

Further, in the present invention, the electric connector can adopt a configuration in which the connector serving as a fitting mate for the electric connector is a plug connector or a receptacle connector.

As described above, such the electric connector according to the present invention is configured such that the connector-side ground connecting member and the board-side ground connecting member that are provided in the conductive ground shell are disposed such that they extend in approximately in parallel with a fitting direction in which the connector serving as a fitting mate for the electric connector is inserted and approximately in the same direction as the fitting direction, so that a ground current flowing between the connector-side ground connecting member and the board-side ground connecting member takes the shortest straight course, thereby substantially suppressing occurrence of electrical loss or an undesired inducing phenomenon, and so that the possibility that the connector as a fitting mate for the electric connector collides with the connector-side ground connecting member is eliminated, thereby preventing deformation such as buckling or damage from occurring, the grounding property of the conductive ground shell can be improved by a simple configuration, and therefore the reliability of the electric connector can be inexpensively and substantially improved.

DESCRIPTION OF THE PREFERRED EMBODIMENTS

Hereinafter, an embodiment where the present invention is applied to an electric connector that connects a plurality of coaxial cables to a printed wiring board will be explained in detail with reference to the drawings.

[Regarding Connector Assembly]

Figure 1:
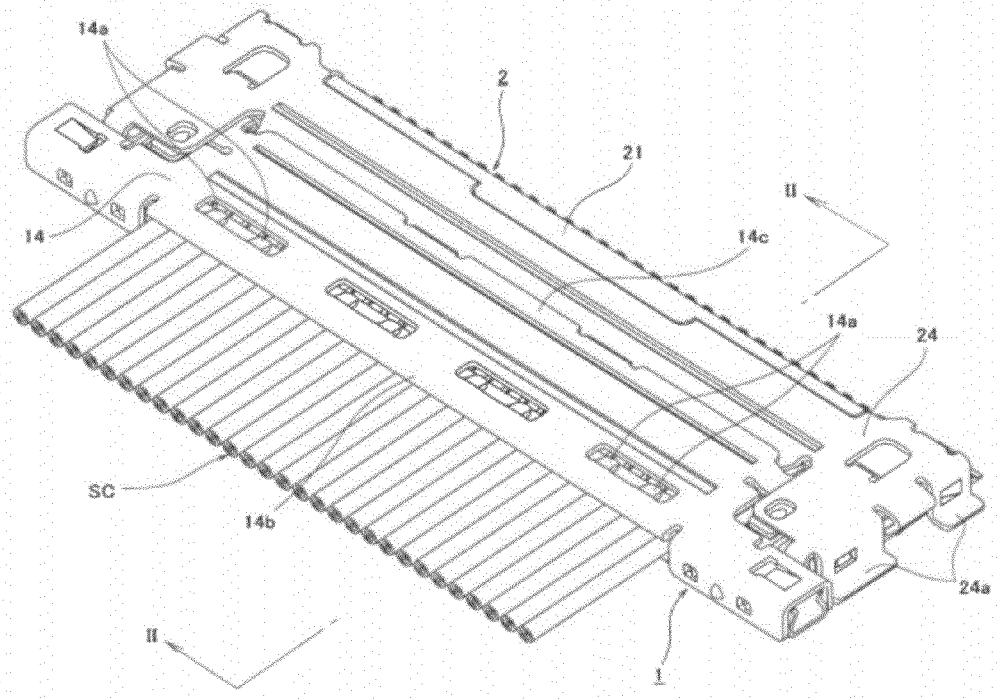
FIG. 1 is an explanatory external perspective view of a connector assembly configured by fitting, to a receptacle connector of an embodiment of the present invention, a plug connector serving as a fitting mate for the receptacle connector.
Figure 2:
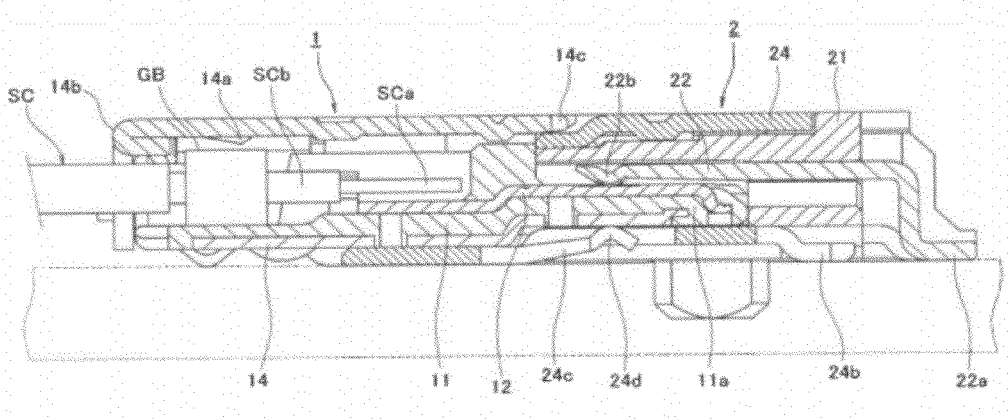
FIG. 2 is an explanatory vertically-sectional view of the connector assembly taken along the line II-II in FIG. 1.

First, an electric connector assembly according to a first embodiment of the present invention shown in FIGS. 1 and 2 is configured as a horizontally-fitting type electric connector comprising a plug connector 1 to which terminal portions of coaxial cables SC are joined and a receptacle connector 2 mounted on a printed wiring board (see the broken lines in FIG. 2). That is, the plug connector 1 which is a connector serving as a fitting mate for the electric connector in the present invention is disposed oppositely and approximately horizontally to the receptacle connector 2 to which the present invention is applied, then the plug connector 1 is moved toward the receptacle connector 2 along a surface of the printed wiring board, a fitting projection 11*a* provided on a front end portion of the plug connector 1 is inserted into an opening 21*b* for fitting provided in the receptacle connector 2, thereby both the connectors 1 and 2 are fitted to each other.

Though, in such a embodiment, as described above, a direction in which the plug connector 1 is inserted and the direction opposite thereto in which the plug connector 1 is pulled out approximately correspond to a direction in which a surface of the printed wiring board extends, hereinafter, the direction in which the surface of the printed wiring board extends is referred to as a horizontal direction, and the direction perpendicular to the surface of the printed wiring board is referred to as a vertical direction. Further, in the plug connector 1, a direction in which the plug connector 1 is inserted into the receptacle connector 2 serving as the mate is referred to as a forward direction, and the direction opposite thereto in which the plug connector 1 is pulled out is referred to as a rearward direction. Furthermore, in the receptacle connector 2, a direction in which the plug connector 1 is pulled out from the receptacle connector 2 is referred to as a forward direction, and the direction opposite thereto is referred to as a rearward direction.

Terminal portions of a plurality of coaxial cables SC disposed in parallel in a multi-polar shape are joined to an end edge portion on the rear side of the plug connector 1 (hereinafter, referred to as rear end edge portion). Cable central conductors (signal lines) SCa and cable outer conductors (shield lines) SCb are coaxially exposed at the respective terminal portions of these coaxial cables SC by peeling off covering members of the coaxial cables, and a signal circuit is configured by connecting the cable central conductors SCa disposed to extend along cable central axes to conductive contacts (conductive terminals) 12 for signal transmission in the plug connector 1 that are described later.

Furthermore, the cable outer conductors SCb disposed along the peripheries of the cable central conductors SCa are disposed such that they are clamped by a ground bar GB provided as a ground member, and the cable outer conductors SCb are connected to the ground bar GB by soldering, caulking, swaging, or the like to configure a ground circuit. The ground bar GB is formed of a long and thin strip-like member extending long in a direction along the array of the multiple poles, and the ground bar GB is placed along upper and lower faces of the cable outer conductors (shield lines) SCb and collectively connected thereto by using a long solder material. This ground bar GB is connected to the ground via conductive ground shells 14, 24 and the like described later.

[Regarding Insulating Housing]

Both the plug connector 1 and the receptacle connector 2 configuring such an electric connector assembly are provided with main body housings 11 and 21, respectively, formed of long and thin insulating members. These main body housings 11 and 21 are formed into hollow casings extending long and thinly in longitudinal directions which are the direction in which the coaxial cables SC are arranged in parallel with each other in the multi-polar shape. The main body housing 11 on the side of the connector 1 serving as a fitting mate for the receptacle connector 2, namely, the plug connector 1, is integrally provided with a main body supporting portion disposed inside the plug connector 1 and fitting projection 11*a* projecting forward and outward from the main body supporting portion, and rear portions of the conductive contacts 12 described later and connection configuration parts with the coaxial cables SC described above are disposed on an upper surface of the main body supporting portion.

Further, the fitting projection 11*a* projecting from the front side of the main body housing 11 is formed of a thin flat-plate-like member configured as a front end portion of the main body housing 11, and is a portion that is first inserted into the receptacle connector 2 when both the connectors 1 and 2 are fitted to each other.

Figure 3:
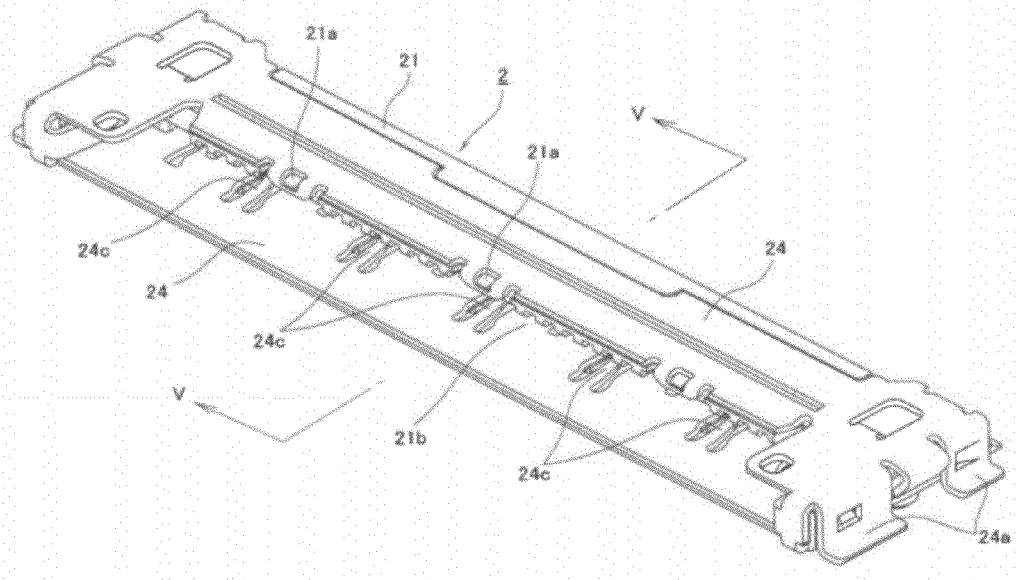
FIG. 3 is an explanatory top external perspective view of the receptacle connector of the connector assembly shown in FIG. 1 alone.
Figure 4:
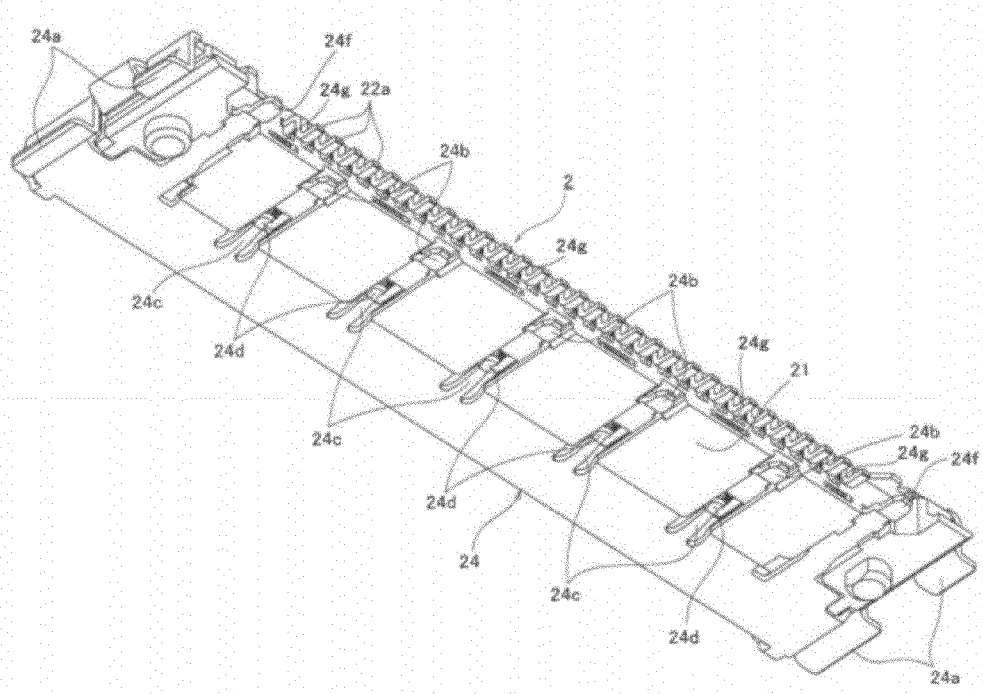
FIG. 4 is an explanatory bottom external perspective view of the receptacle connector shown in FIG. 3.
Figure 5:
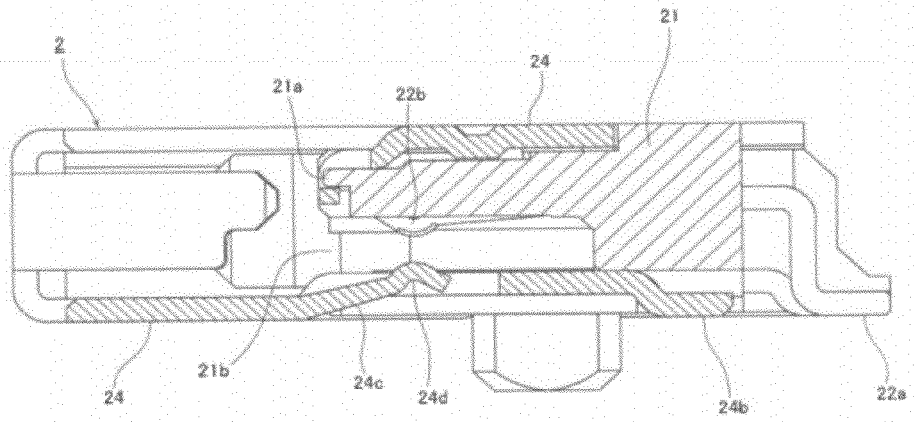
FIG. 5 is an explanatory vertically-sectional view of the receptacle connector taken along the line V-V in FIG. 3.

On the other hand, as especially shown in FIGS. 3 to 5, the opening 21*b* for fitting defined by a long and narrow space extending in the longitudinal direction is formed in a front end portion of the main body housing 21 of the receptacle connector 2, and, when both connectors 1 and 2 are fitted to each other, the fitting projection 11*a* of the plug connector 1 is approximately horizontally inserted into the opening 21*b* for fitting of the receptacle connector 2.

[Regarding Conductive Contact]

Furthermore, in both the main body housings 11 and 21 described above, a number of conductive contacts (conductive terminals) 12 and 22 are arranged in a multi-polar shape at suitable intervals along the longitudinal direction (a direction perpendicular to a plane of paper of FIG. 2). Though the respective conductive contacts 12 and 22 shown in FIG. 2 are configured for signal transmission, they can be configured for ground connection. Each of the plurality of conductive contacts 12 and 22 is formed of approximately the same material and in approximately the same shape as or in a different shape from conductive contacts adjacent thereto in the above-described direction of the multi-pole array (longitudinal directions of the connectors), and, for example, they are embedded in the main body housings 11 and 21 by insert molding or press-fitted thereto.

Of them, the conductive contacts 12 provided in the plug connector 1 are disposed such that they extend approximately horizontally along an upper surface of the main body housing 11, and their rearward extensions extending rearward from stepped portions provided in the middles of the conductive contacts 12 in their extending directions are disposed on the side of an upper surface of the main body supporting portion of the main body housing 11. The cable central conductors (signal lines) SCa of the coaxial cables SC are soldered to the rearward extensions of the conductive contacts 12 such that they are placed and abutted thereon. The soldering of the plurality of cable central conductors SCa to the conductive contacts 12 is collectively performed.

On the other hand, terminal electrodes configuring forward extensions extending forward from the stepped portions of the conductive contacts 12 are disposed on an upper surface of the fitting projection 11*a* provided so as to configure the front end portion of the main body housing 11. These terminal electrodes are disposed in a multi-polar shape at suitable intervals on the upper surface of the fitting projection 11*a* of the above-described main body housing 11.

On the other hand, the conductive contacts (conductive terminals) 22 attached to the main body housing 21 of the receptacle connector 2 are provided, in their rear end portions (a right end portion in FIG. 2), with solder connections 22*a* having an approximately inverted L-shaped section in side view. Before an actual use, the solder connections 22*a* are placed on signal conducting paths or ground conducting paths on the above-described printed wiring board (see the broken lines in FIG. 2), and then soldered collectively thereto.

Further, the conductive contacts (conductive terminals) 22 extend forward from the above-described solder connections 22*a* on the rear end side in a cantilever form. More specifically, the conductive contacts 22 are bent approximately vertically upward from the solder connections 22*a* on the rear end side, and are extended forward (leftward in FIG. 2) from upper end portions of the bends in a cantilever form. Then, contact point projections 22*b* projecting downward into V shapes are provided in forward distal ends of the conductive contacts 22. These contact point projections 22*b* provided on the conductive contacts 22 are configured to come into contact with contact point recesses provided in the conductive contacts 12 of the plug connector 1 in a spring-elastic manner when the above-described plug connector 1 is fitted into the receptacle connector 2. Through such a contact relationship, both the contact point portions are electrically connected to each other.

[Regarding Conductive Ground Shell]

On the other hand, conductive ground shells 14 and 24 formed by bending thin plate-like metal members into suitable shapes are attached to the respective main body housings 11 and 21 of the plug connector 1 and the receptacle connector 2, respectively. These conductive ground shells 14 and 24 are disposed covering outer surfaces of the main body housings 11 and 21, and have shielding performances with respect to the respective transmission signals in the respective connectors 1 and 2 and function to configure parts of the ground circuit. The conductive ground shells 14 and 24 configuring the ground circuit are portions that are first electrically connected when both the above-described connectors 1 and 2 are fitted to each other.

First, attachment of the conductive ground shell 14 to be provided on the side of the plug connector 1 that is the connector serving as a fitting mate for the receptacle connector 2 is performed, after the above-described soldering of the ground bar GB to the coaxial cables SC, such that the main body housing 11 is covered from both above and below. Incidentally, a lower half portion of the conductive ground shell 14 in this embodiment is integrated with the main body housing 11 by insert molding.

Further, a plurality of ground connecting tongue pieces 14*a* are formed in a cutout shape on an upper face of the conductive ground shell 14 along a connector longitudinal direction which is the direction of the multi-pole array. The respective ground connecting tongue pieces 14*a* are formed of a cantilever plate-spring-like member, extended forward and obliquely downward, and soldered or brought in elastic contact with an upper face of the above-described ground bar GB.

Furthermore, a pressing projection 14*b* folded back downward and inward is formed on a rear end edge portion (a left end portion in FIG. 2) of the upper face of the above-described conductive ground shell 14, and, when the attachment of the conductive ground shell 14 is performed in the above-described manner, the pressing projection 14*b* is brought into vertically-downward pressure contact with an insulation sheaths of the coaxial cables SC.

Furthermore, a pressing pressure plate 14*c* formed in an eave shape is provided at a front end edge portion (a right end portion in FIG. 2) on the side of the upper face of the conductive ground shell 14. The pressing pressure plate 14*c* is configured to project approximately horizontally by a proper size forward (rightward in FIG. 2) from an opening end edge on a front end side of the main body housing 11, and, as described later, the pressing pressure plate 14*c* of the conductive ground shell 14 is configured to be attached in contact with an outer surface of the opening 21*b* for fitting of the receptacle connector 2.

On the other hand, in the conductive ground shell 24 provided on the receptacle connector 2, side holddowns (soldering pieces) 24*a* and rear holddowns (soldering pieces) 24*b* as board-side ground connecting members are provided in both ends in the connector longitudinal direction thereof and a rear end edge thereof, respectively. The respective holddowns (board-side ground connecting members) 24*a* and 24*b* are formed in a bending manner to extend outward from both the ends in the longitudinal direction and outward (rightward in FIG. 2) from the rear end, and soldered to ground conductive paths (not shown) formed on the printed wiring board (see the broken lines in FIG. 2) so that electrical connection of the ground circuit is performed, and the entire receptacle connector 2 is firmly fixed.

Incidentally, the rear holddowns (board-side ground connecting members) 24*b* provided in the rear end edge of the conductive ground shell 24 configure a main component of the present invention, therefore it will be explained later in detail.

Further, catching projections 21*a* projecting forward (leftward in FIG. 2) in a fitting direction (horizontal direction) in which the receptacle connector 2 is fitted to the plug connector 1 that is the connector serving as a fitting mate for the receptacle connector 2 are provided on an opening end edge portion of the main body housing 21. Further, catching holes into which the catching projections 21*a* of the main body housing 21 are inserted in the fitting direction (horizontal direction) are provided in an opening end edge portion of the conductive ground shell 24, and a plurality of fixation mechanisms each of which comprises one catching projection 21*a* of the main body housing 21 and one catching hole of the conductive ground shell 24 corresponding thereto which are paired are disposed at suitable intervals in the longitudinal direction of the receptacle connector 2. The relationship between the catching projection 21*a* and the catching hole is such that they abut on each other in vertical directions perpendicular to the fitting directions of both the connectors 1 and 2, so that good fixation force in the same direction (vertical direction) can be obtained, and a fixing function obtained by such a fixation mechanism comprising the catching projection 21*a* and the catching hole keeps the main body housing 21 and the conductive ground shell 24 fixed well in the vertical directions perpendicular to the fitting directions of both the connectors 1 and 2.

Further, the opening end edge of the conductive ground shell 24 is formed in a bent and stepped shape which is bent downward by one step and then extended, and both the connectors 1 and 2 are fitted to each other such that the above-described pressing pressure plate 14*c* provided on the front end edge (right end in FIG. 2) of the conductive ground shell 14 of the plug connector 1 serving as the mating connector is brought into vertical contact with a lower stepped portion of the conductive ground shell 24. Then, when both the connectors 1 and 2 have been fitted to each other, their positional relationship is such that an inner surface of the conductive ground shell 14 of the plug connector 1 is in contact with an outer surface of the conductive ground shell 24 of the receptacle connector 2, and, in such a fitted state, the conductive ground shells 14 and 24 of both the connectors 1 and 2 are disposed overlapping with each other in the vertical direction perpendicular to the fitting directions.

Further, in such a state that the conductive ground shells 14 and 24 of both the connectors 1 and 2 overlap with each other in the vertical direction perpendicular to the fitting directions, as described above, the main body housing 21 and the conductive ground shell 24 fixed in the above-described manner are held via the conductive contacts 22 of the receptacle connector 2 between the pressing pressure plate 14*c* provided in the conductive ground shell 14 of the plug connector 1 and the fitting projection 11*a* provided in the main body housing 11 of the plug connector 1.

That is, when the fitting projections 11*a* of the plug connector 1 which is the connector serving as a fitting mate for the electric connector are inserted into the main body housing 21 of the receptacle connector 2, the fitting projections 11*a* of the plug connector 1 are brought into vertical pressure contact with the conductive contacts 22 of the receptacle connector 2, as described above, thereby the conductive contacts 22 are displaced in an upwardly-lifting manner. Then, with such upward displacement of the conductive contacts 22, both the opening end edges of the main body housing 21 and the conductive ground shell 24 are biased in such a manner as to be stretched in an expanding manner upward, particularly in the center in the longitudinal direction. However, in this embodiment, as described above, such a configuration that the main body housing 21 and the conductive ground shell 24 of the receptacle connector 2 are sandwiched between the fitting projections 11*a* of the plug connector 1 and the pressing pressure plate 14*c* of the conductive ground shell 14 thereof is adopted. In particular, the main body housing 21 and the conductive ground shell 24 of the receptacle connector 2 are pressed downward by the pressing pressure plate 14*c* of the plug connector 1, which well prevents upward expansion or bulging of both the opening end edges of the main body housing 21 and the conductive ground shell 24 of the receptacle connector 2.

Figure 6:
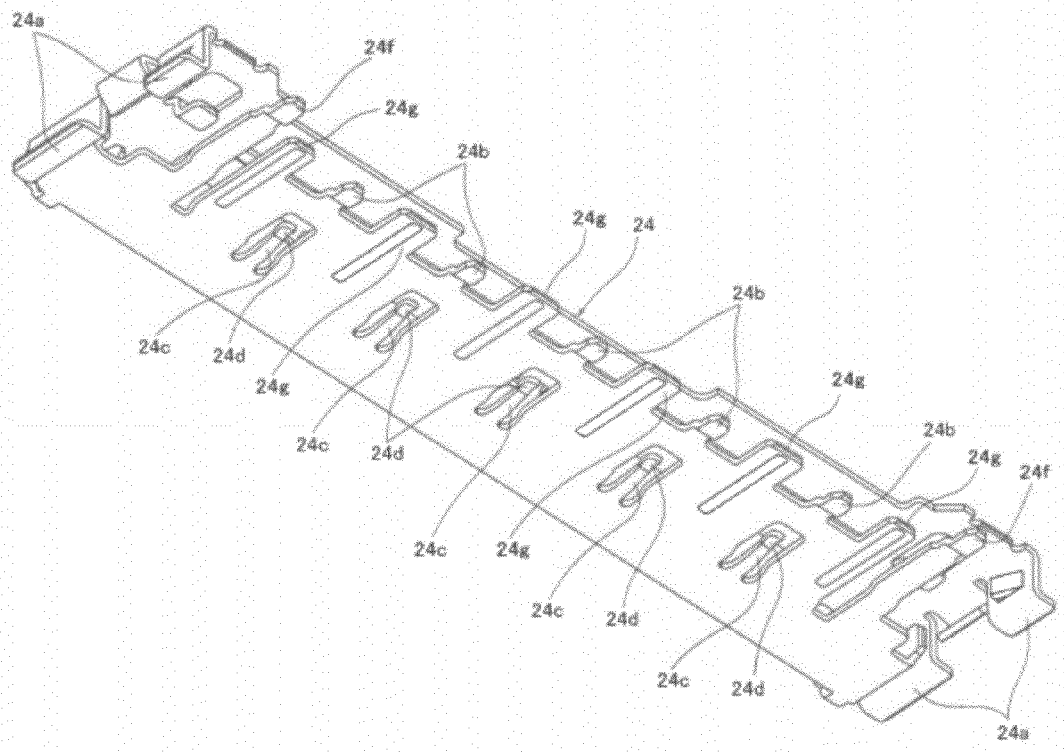
FIG. 6 is an explanatory bottom external perspective view of a conductive ground shell used in the receptacle connector shown in FIGS. 3 to 5.

On the other hand, in the conductive ground shell 24 attached to the main body housing 21 of the receptacle connector 2, as described above, the rear holddowns (soldering pieces) 24*b* and 24*f* as board-side ground connecting members are provided in the rear end edge of the conductive ground shell 24. The rear holddowns 24*b* and 24*f* as the board-side connecting members are, as shown particularly in FIGS. 5 and 6, formed of tongue-piece-like members extending rearward (rightward in FIG. 5) integrally from a rear end edge of a bottom plate of the conductive ground shell 24, and plural (seven) holddowns 24*b* and 24*f* are disposed at predetermined intervals in a longitudinal direction (a direction perpendicular to a sheet of paper of FIG. 5).

Though the respective holddowns (board-side ground connecting members) 24*b* and 24*f* are provided to extend rearward in a cantilever form, the extending portions are formed so as to be bent downward in a stepped manner (rightward in FIG. 5), and the distal ends of these downward-bent portions are collectively soldered to the ground conducting paths (not shown) formed on the printed wiring board (see the broken lines in FIG. 2).

Further, ground spring pieces 24*c* serving as connector-side ground connecting members that are brought in contact with the conductive ground shell 14 of the plug connector 1 which is a connector serving as a fitting mate for the receptacle connector 2 are provided in the conductive ground shell 24. The ground spring pieces 24*c* serving as the connector-side ground connecting members have shapes obtained by cutting and bending up portions of the conductive ground shell 24 in a cantilever form, and formed of tongue-piece-like members extending rearward (rightward in FIG. 5), like the rear holddowns (board-side ground connecting members) 24*b* described above.

Projecting contacts 24*d* curving and projecting upward are provided at the distal ends of the extensions of these ground spring pieces (connector-side ground connecting members) 24*c*, and the projecting contacts 24*d* are configured to come into vertical elastic contact with the conductive ground shell 14 of the plug connector 1 serving as the fitting mate from below.

Further, the ground spring pieces (connector-side ground connecting members) 24*c* are disposed at positions corresponding to the rear holddowns (board-side ground connecting members) 24*b* described above, more specifically, the respective ground spring pieces 24*c* are disposed slightly in front (to the left in FIG. 5) of the respective rear holddowns 24*b*. Incidentally, ground spring pieces corresponding to two rear holddowns 24*f* provided on both the ends in the longitudinal direction (a direction perpendicular to a sheet of paper of FIG. 5) are not provided.

Then, as described above, the respective rear holddowns (board-side ground connecting members) 24*b* and the respective ground spring pieces (connector-side ground connecting members) 24*c* disposed back and forth correspondingly are positioned on the same lines extending in approximately parallel with a front-back direction which is the fitting direction of the plug connector (the connector serving as a fitting mate for the receptacle connector 2) 1. That is, both the members 24*b* and 24*c* disposed on the same line configure a portion of the ground circuit as one pair, and both the members 24*b* and 24*c* configuring each pair have a positional relationship in which their respective central lines extending in a widthwise direction that is perpendicular to the connector longitudinal direction approximately correspond to each other.

Figure 7:
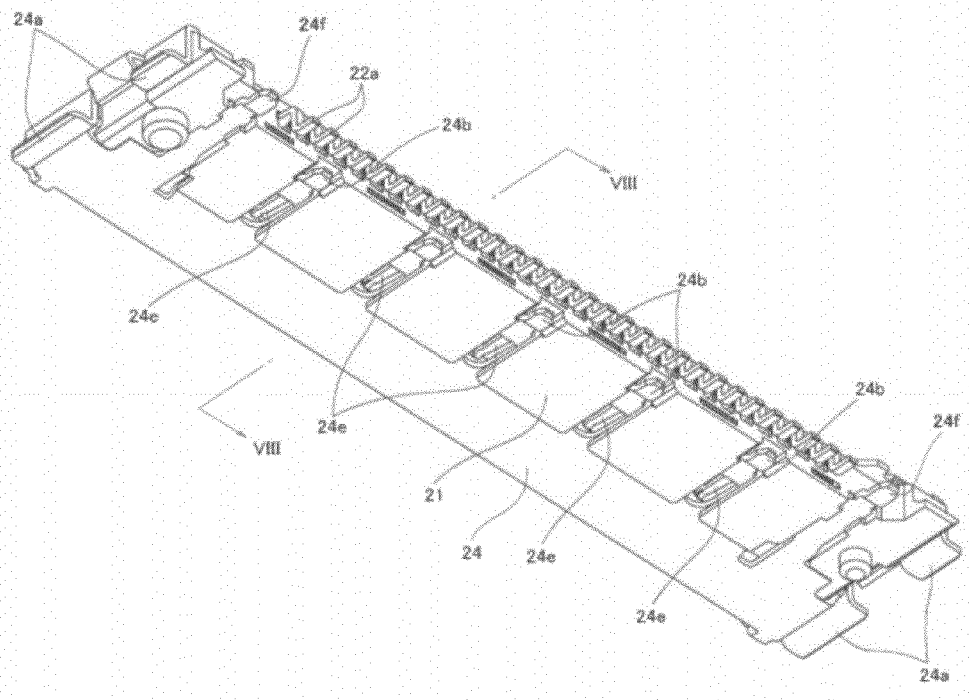
FIG. 7 is an explanatory bottom external perspective view of the receptacle connector according to another embodiment of the present invention.

Further, a plurality of projections 24*g* is formed at the both sides of the respective rear holddowns (board-side ground connecting members) 24*b* which are disposed on the line between the respective ground spring pieces (connector-side ground connecting members) 24*c*. Theses respective projections 24*g* are arranged at suitable intervals along the longitudinal direction of the main body housing 11 so as to extend from the rear edge of the conductive ground shell 24 along the fitting direction in which the plug connector 1 serving as a fitting mate for the receptacle connector 2 is inserted. When the conductive ground shell 24 is attached to the main body housing 11, the entire length of the projections 24*g* is inserted in the main body housing 11 as shown in FIG. 7.

According to this embodiment having such a configuration, ground currents flowing between the rear holddowns (board-side ground connecting members) 24*b* and the ground spring pieces (connector-side ground connecting members) 24*c* take the shortest straight courses, therefore occurrence of electrical loss or an undesired inducing phenomenon is substantially suppressed.

In particular, in this embodiment, since the ground spring pieces (connector-side ground connecting members) 24*c* and the rear holddowns (board-side ground connecting members) 24*b* extend in a forward direction with respect to the direction in which the plug connector 1 which is a connector serving as a fitting mate for the receptacle connector 2 is fitted, particularly, the possibility that the fitting projections 11*a* of the plug connector 1 collide with the ground spring pieces 24*c* when the plug connector 1 is fitted is eliminated, therefore, deformation such as buckling or damage is prevented from occurring.

Further in this embodiment, the rear holddowns (board-side ground connecting members) 24*b* are disposed in the region of the main body housing 21 that is positioned in front (to the left in FIG. 5) of the solder connections 22*a* of the conductive contacts 22. The configuration of the rear holddowns 24*b* is such that plural (five) rear holddowns 24*b* are disposed at predetermined intervals in the longitudinal direction (direction perpendicular to a sheet of paper of FIG. 5). Then, due to such a configuration, electrical connections between the rear holddowns (board-side ground connecting members) 24*b* and the ground conducting paths (not shown) formed on the printed wiring board (see the broken lines in FIG. 2) are performed without increasing a projection area of the receptacle connector 2 in planar view, and the entire receptacle connector 2 is firmly fixed.

Figure 8:
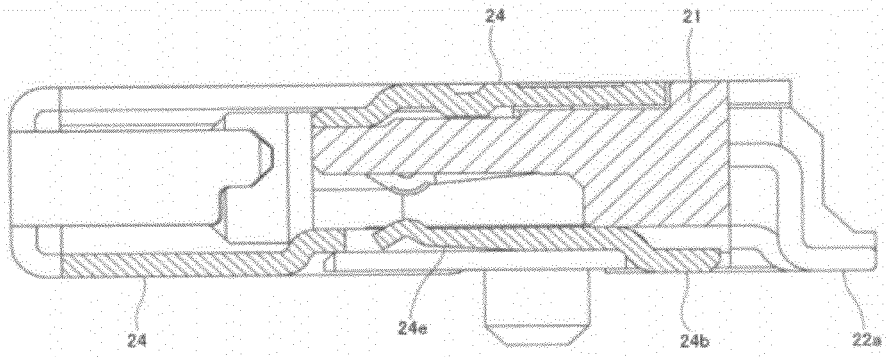
FIG. 8 is an explanatory vertically-sectional view of the receptacle connector taken along the line VIII-VIII in FIG. 7.
Figure 9:
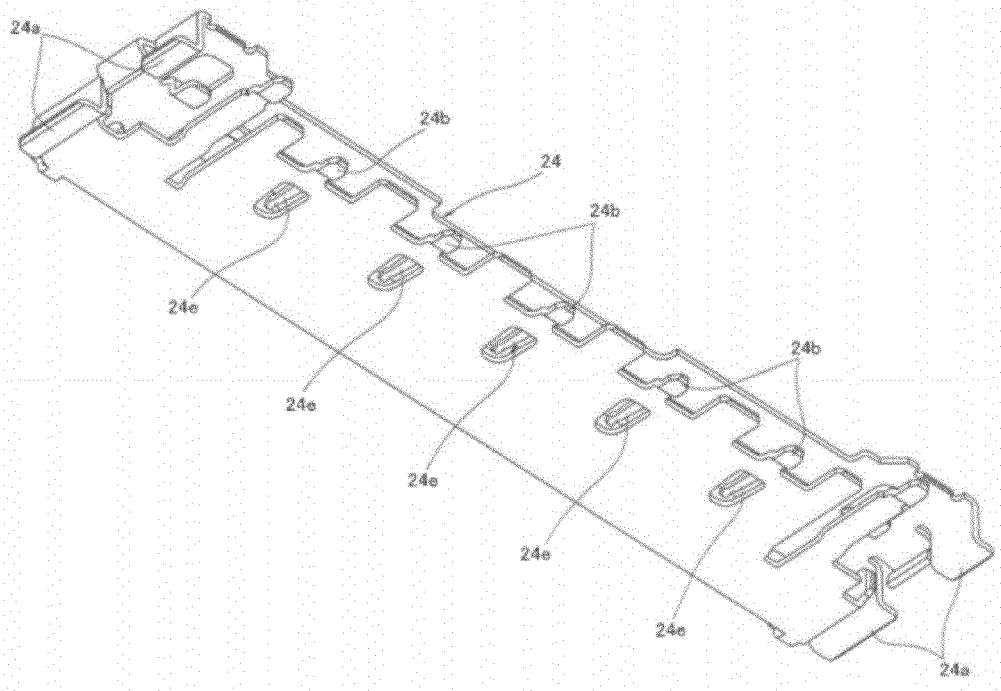
FIG. 9 is an explanatory bottom external perspective view of a conductive ground shell used in the receptacle connector according to the embodiment shown in FIGS. 7 and 8.

Further, in a second embodiment shown in FIGS. 7 to 9 in which the same components as the above-described first embodiment has been denoted by the same reference numerals, like the above-described embodiment, the rear holddowns (board-side ground connecting members) 24*b* are formed of tongue-piece-like members extending rearward (rightward in FIG. 8) integrally from the rear end edge of the bottom plate of the conductive ground shell 24, and ground spring pieces (connector-side ground connecting members) 24*e* are similar to the ground spring pieces (connector-side ground connecting members) 24*c* of the above-described embodiment in that they have shapes obtained by cutting and bending up portions of conductive ground shell 24 in a cantilever form. On the other hand, the ground spring pieces (connector-side ground connecting members) 24*e* according to the second embodiment are formed of tongue-piece-like members extending in a cantilever form in a direction opposite to the direction in the first embodiment, namely, forward (leftward in FIG. 8).

Then, also in this second embodiment, the respective ground spring pieces (connector-side ground connecting members) 24*e* and the respective rear holddowns (board-side ground connecting members) 24*b* are disposed on the same lines extending approximately in parallel with a front-back direction that is the fitting direction of the plug connector 1, and have such a positional relationship that the respective central lines of both the members 24*e* and 24*b* extending in the widthwise direction approximately correspond to each other.

Also in this embodiment having such a configuration, ground currents flowing between the ground spring pieces (connector-side ground connecting members) 24*e* and the rear holddowns (board-side ground connecting members) 24*b* take the shortest straight courses, therefore occurrence of electrical loss or an undesired inducing phenomenon are greatly suppressed.

Hereinbefore, the invention which has been made by the present inventor has been explained based upon its embodiments, but, the present invention is not limited to the above-described embodiments, but obviously can be modified variously within the scope of gist thereof.

For example, in the above-described embodiments, both the connector-side ground connecting members and the board-side ground connecting members are formed of tongue-piece-like members of the cantilever type, but, it is possible to adopt such a configuration that either or both of the members are formed of contact members independent of the conductive ground shell.

Further, the above-described embodiments of the present invention are applied to the receptacle connector, but, the present invention can also be applied to a plug connector similarly. A connector serving as a fitting mate for the plug connector in this case is a receptacle connector.

Further, in the above-described embodiments, a printed wiring board is adopted as the board, but, a variety of boards such as an FPC or an FFC can be adopted.

Furthermore, the above-described embodiments of the present invention are applied to the horizontally-fitting-type electric connector, but, the present invention can also be applied to a vertically-fitting-type electric connector similarly. Further, the present invention is not limited to such a connector for coaxial cables as the above-described embodiments, but can also be applied similarly to a connector for insulated cables, an electric connector of a type that mixes plural coaxial cables and plural insulated cables, an electric connector to which a flexible wiring board or the like is joined, a board-to-board connector that connects printed boards to each other, or the like.

Industrial Applicability

As described above, the present invention can widely be applied to a variety of electric connectors used in various electrical equipments.

What is claimed is:

1. An electric connector used in the state of being inserted with a connector serving as a fitting mate for the electric connector comprising:

a main body housing formed of long and thin insulating members, a conductive ground shell attached to the main body housing, a connector-side ground connecting member to be brought into contact with the conductive ground shell of the connector serving as the fitting mate for the electric connector, a board-side ground connecting member to be brought in contact with a printed wiring board, a plurality of connector-side ground connecting members and board-side ground connecting members being arranged at suitable intervals along the longitudinal direction of the main body housing, each of the plurality of the connector-side ground connecting members and the board-side ground connecting members extending in a cantilever form;

wherein the extending directions in the cantilever form of the connector-side ground connecting member and the board-side ground connecting member are set approximately in parallel with the inserting direction of the connector serving as the fitting mate for the electric connector and approximately in a same direction as a fitting direction so that respective board-side ground connecting members and respective connector-side ground connecting members are positioned on the same lines to configure each pair of the board-side ground connecting member and the connector-side ground connecting member, and a plurality of pairs of the board-side ground connecting member and the connector-side ground connecting member are disposed on the same line are arranged along the longitudinal direction of the main body housing.

2. The electric connector according to claim 1, wherein at least one of the connector-side ground connecting member and the board-side ground connecting member is formed of a tongue-piece-like member integrated with the conductive ground shell.

3. The electric connector according to claim 1, wherein at least one of the connector-side ground connecting member and the board-side ground connecting member is formed of a contacting member independent of the conductive ground shell.

4. The electric connector according to claim 1, wherein another connector serving as a fitting mate for the electric connector is a plug connector or a receptacle connector.

* * * * *